US006173538B1

(12) United States Patent
Fleishman

(10) Patent No.: US 6,173,538 B1
(45) Date of Patent: Jan. 16, 2001

(54) MODULAR CONSTRUCTION SYSTEM

(76) Inventor: Gregg R. Fleishman, 3850 Main St., Culver City, CA (US) 90232

( * ) Notice: Under 35 U.S.C. 154(b), the term of this patent shall be extended for 0 days.

(21) Appl. No.: 08/962,233

(22) Filed: Oct. 30, 1997

(51) Int. Cl.[7] ..... E04B 1/32

(52) U.S. Cl. ..... 52/81.4; 52/81.1; 52/81.3; 52/79.4; 52/284; 52/590.1

(58) Field of Search ..... 52/80.1, 81.1, 52/81.2, 81.3, 81.4, 81.5, 792.11, 655.1, 646, 648.1, 387, 79.4, 578, 582.1, 590.1, 589.1, 284, 286; 446/115, 108, 127

(56) References Cited

U.S. PATENT DOCUMENTS 3,066,436 * 12/1962 Schun ..... 446/115
3,611,620 * 10/1971 Perry ..... 446/127
3,638,384 * 2/1972 Martin ..... 52/589.1
3,646,718 * 3/1972 McKenna ..... 52/81.1 X
3,660,952 * 5/1972 Wilson ..... 52/81.4
4,422,267 * 12/1983 Whitehouse ..... 52/80.1
4,611,411 * 9/1986 Wickens ..... 52/81.4
4,621,467 * 11/1986 Golden ..... 52/81.1
4,907,382 * 3/1990 Schwam ..... 51/81.1
5,400,918 * 3/1995 Prodaniuk ..... 446/115 X
5,560,151 * 10/1996 Roberts ..... 52/81.4 X
5,601,470 * 2/1997 Yao ..... 446/127
5,623,790 * 4/1997 Lalvani ..... 52/81.2
5,706,624 * 1/1998 Lipson ..... 52/81.1 X

* cited by examiner

*Primary Examiner*—Carl D. Friedman
*Assistant Examiner*—Winnie S. Yip
(74) *Attorney, Agent, or Firm*—Lyon & Lyon LLP

(57) ABSTRACT

A structural assembly for building dodecahedral-based structures for habitable or commercial use, or for use as play equipment, models, or toys, is provided. Panels with shapes including hexagonal, rhombic, and trapezoidal are assembled edge-to-edge using ordered edge connections (i.e. alternating connector and receptor edges) to minimize the number of different panels required for producing a complete structure.

18 Claims, 5 Drawing Sheets

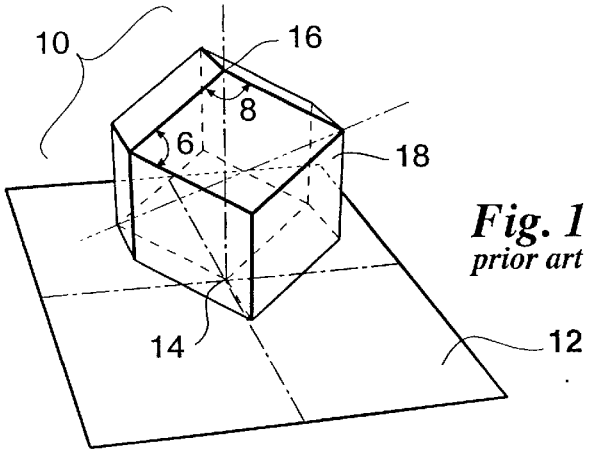
*Fig. 1*
*prior art*
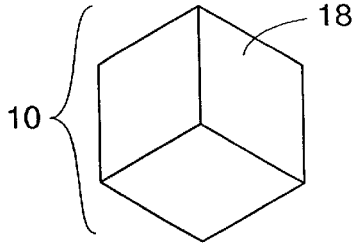
*Fig. 2*
*prior art*
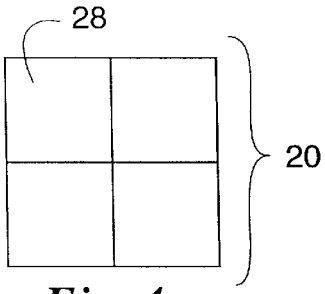
*Fig. 4*
*prior art*
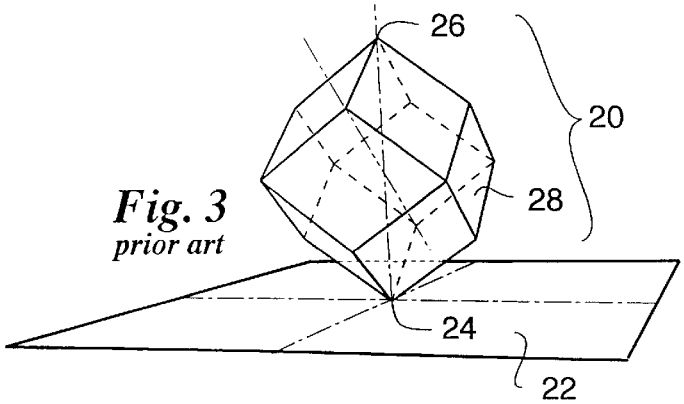
*Fig. 3*
*prior art*
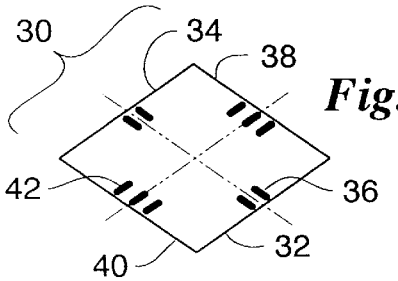
*Fig. 5a*
*Fig. 5b*
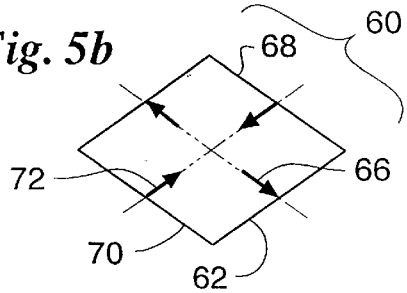
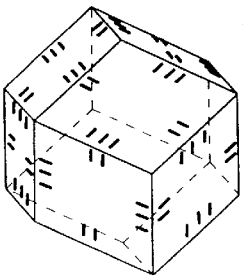
*Fig. 6a*
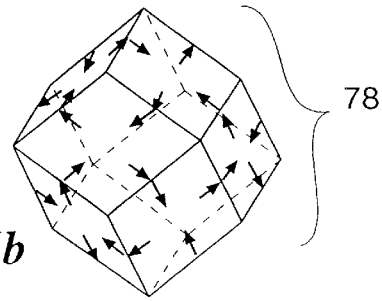
*Fig. 6b*

MODULAR CONSTRUCTION SYSTEM

FIELD OF THE INVENTION

The present invention relates to the fields of residential or commercial structures, and models, toys, and play equipment. More specifically, it relates to the modular construction of dodecahedral-based structures having panels with ordered edge connections.

BACKGROUND OF THE INVENTION

The building industry of today is dominated by conventional designs and construction practices. Conventional building techniques are very time-consuming, generally requiring a substantial amount of field labor. Moreover, mobilizing fabrication resources to the field is expensive, while it is also difficult to ensure a consistent level of quality. Conventional construction is also dominated by volumetric spaces bounded by rectangular or mixed rectangular-trapezoidal shapes.

The most notable successful departures from conventional designs and construction practices have been for large-scale enclosures for assemblies or other special purposes where domes, tent structures, and inflatable structures are becoming part of the accepted vocabulary. Success for alternative designs and construction practices has been more elusive for large enclosures through the aggregation of smaller structures for uses such as housing, condominium blocks, or office buildings. "Habitat" at the 1967 Montreal Expo is the only famous non-traditional project of this genre, built of concrete in rectangular modularity, but it was notable for its high cost and has not been duplicated.

Prefabrication of building components, such as trusses and walls, is well known in the art and reduces some of the disadvantages (noted above) inherent in conventional field construction. Construction using these standardized, prefabricated components, however, continues to suffer from substantial limitations. Achieving complex or distinctive geometries using prefabricated components requires a large number of different components, which elevates their cost of supply. And, only a relatively small range of different overall structure geometries may be economically achieved using known standardized and prefabricated components. Moreover, many standardized and prefabricated components are not designed or cannot be designed to be interchangeably fastened to the gamut of other prefabricated components produced by the same manufacturer.

Using geodesic space fillers of varieties other than rectangular modularity for building construction represents a departure from conventional design. With such space fillers, smaller parts can create modules which can then be used to construct buildings of large sizes and unusual forms.

One known space filling geometry is the rhombic dodecahedron. An unmodified, closed module of this type has 12 sides, with each side consisting of a 4-edged rhombus. Being more complex for filling space than conventional square or rectangular cubic (6-sided) units, the rhombic dodecahedron represents a balance between allowing the construction of unusual forms while keeping the overall number of sides down to an economical number. The rhombic dodecahedron is characterized by having eight 3-point vertices, and six 4-point vertices.

The basic rhombic dodecahedral module may also be modified, for instance, by 'stretching' selected side shapes from rhombic forms into hexagons or 'twisting' selected side shapes into trapezoids. Such modified forms may have twelve 3- point vertices and two 4-point vertices. Myriad variations of these modified forms are possible, depending on the acuteness of the angles embodied in the side shapes.

Though the rhombic dodecahedral form is known as a space filling geometry (Peter Pearce, Structure in Nature is a Strategy for Design), this geometry is not presently applied to the construction of economical modular structures.

SUMMARY OF THE INVENTION

The present invention provides a novel structural assembly for fabricating structures based on variations of the rhombic dodecahedral (12- sided) module. This assembly uses a very simplified ordered edge connection system incorporated with planar panels to minimize the number of different panels required, while significantly reducing construction cost. The peripheral edges of these panels comprise alternating connectors and receptors, such that the panel edges with connectors may be interconnected with the panel edges with receptors. Preferred embodiments of the assembly according to the present invention utilize premanufactured panels to allow for more rapid assembly in less developed areas with a consistent and predetermined level of quality.

A preferred embodiment of an assembly according to the present invention utilizes hexagonal and rhombic shaped panels for portions of the structure not joined to a building surface underlying the assembly. For portions of the structure which are joined to an underlying building surface, a preferred embodiment of an assembly according to the present invention further uses base panels, pentagonal in shape, with one surface connector edge (for connecting with the underlying building surface). Thus, an entire structure may be built using only the three aforementioned kinds of panels (hexagonal, rhombic, and pentagonal). The small number of different types of panels required can reduce production and storage costs, resulting in a reduced cost to the consumer.

Alternative embodiments of an assembly according to the present invention may utilize trapezoidal and rhombic shaped panels for the portions of the structure not joined to a building surface underlying the assembly. Such alternative embodiments may further incorporate trapezoidal base panels, each with one surface connector edge for connecting the structure to an the underlying building surface or foundation.

A preferred embodiment of the panels used to construct an assembly according to the present invention each comprise a peripheral frame and at least one panel layer attached to the frame.

While the preceding embodiments relate to the modular construction of structures for habitable or commercial use, a further alternative embodiment relates to structures that may be used as play equipment, models, or toys. This alternative embodiment of the assembly according to the present invention utilizes planar panels of the basic shapes described previously (hexagonal, rhombic, trapezoidal, and/or pentagonal), but with simplified panel connector and receptor edges. These simplified connectors contain one or more protruding tabs, and the simplified receptor edges contain one or more slots for receiving the one or more protruding tabs.

BRIEF DESCRIPTION OF THE DRAWINGS

FIG. 1 provides a perspective view of a prior art rhombic dodecahedron, with a three-point vertex of the dodecahedron in contact with a base plane, such that six sides of the shape are disposed in planes perpendicular to the base plane.

FIG. 2 provides a top view of the prior art rhombic dodecahedron shown in FIG. 1.

FIG. 3 provides a perspective view of a prior art rhombic dodecahedron, with a four-point vertex of the dodecahedron in contact with a base plane, such that four sides of the shape are disposed in planes orthogonal to the base plane.

FIG. 4 provides a top view of the prior art rhombic dodecahedron shown in FIG. 3.

FIGS. 5A and 5B provide simplified front views of one panel of a rhombic dodecahedral module, depicting different representations of ordered edge connections.

FIGS. 6A and 6B provide simplified perspective views of a closed rhombic dodecahedral module assembled according to the ordered edge connections depicted in FIGS. 5A and 5B, respectively.

DETAILED DESCRIPTION OF THE DRAWINGS

Figure 7:
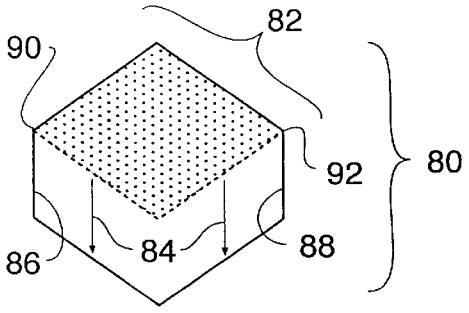
FIG. 7 provides a simplified front view of one hexagonal panel of a modified (hexagonal) dodecahedron, compared with a compatible rhombic panel (shadowed).

FIG. 1 illustrates a perspective view of a prior art rhombic dodecahedron 10 in contact with a base plane 12 at a three point vertex 14 of the dodecahedron 10, and with another three point vertex 16 disposed at the apex of dodecahedron 10. Positioning the dodecahedron 10 in this manner relative to base plane 12 places six sides 18 of dodecahedron 10 in planes orthogonal to base plane 12. As described previously, a rhombic dodecahedron is characterized by having twelve sides, assembled with eight 3- point vertices and six 4-point vertices. Each side 18 of dodecahedron 10 is shaped as a rhombus and is interchangeable with other sides. Each rhombic side 18 is characterized by having corner angles: an acute angle 6, and an obtuse angle 8.

FIG. 2 illustrates a top view of the prior art rhombic dodecahedron 10 provided in FIG. 1. Alternatively, since the top and bottom views of rhombic dodecahedron 10 are indistinguishable, FIG. 2 may represent a bottom view of the same.

FIG. 3 illustrates a perspective view of a prior art rhombic dodecahedron 20 in contact with a base plane 22 at a four point vertex 24 of the dodecahedron 20, and with another four point vertex 26 disposed at the crest of the dodecahedron. Positioning the dodecahedron 20 in this manner relative to base plane 22 places four sides 28 of dodecahedron 20 in planes perpendicular to base plane 22. Each side 28 of dodecahedron 20 is shaped as a rhombus and is interchangeable with other sides and with sides 18 of dodecahedron 10.

FIG. 4 illustrates a top view of the prior art rhombic dodecahedron 20 provided in FIG. 3. Alternatively, since the top and bottom views of rhombic dodecahedron 20 are indistinguishable, FIG. 4 may represent a bottom view of the same.

Shifting now from the prior art to the present invention, what were previously characterized as 'sides' of the rhombic dodecahedron space filling geometry will now be referred to as 'panels.' The interconnection of two or more panels defines an assembly. In addition, a geometric form which was previously described as a 'dodecahedron,' in addition to variations on or modifications to a single dodecahedron, will now be referred to as a 'module.' A module may be further described as being either 'open' or 'closed'—closed module being defined generally as one having twelve contiguous panels and defining an enclosed volume (notwithstanding any apertures defined within a particular panel), and an open module being defined as any module having less than the full complement of twelve contiguous panels. Multiple modules may be interconnected, such as to form a structure— although a single module may also constitute a structure. Where two adjacent modules having twelve continuous panels share one panel, both such modules are defined as closed. Where a module is intersected with a plane, to form a floor in addition to eight or more additional panels which define an enclosed volume, the resulting form is deemed a closed base module. Where a single truncated module does not define an enclosed volume, it is deemed an open base module. Finally, base panels are panels that are truncated at their bottom (such as from a hexagon to a pentagon, or from a trapezoid to a right trapezoid) and used to connect a structure with an underlying surface or foundation.

FIG. 5A illustrates a simplified front view of one panel 30 of a rhombic dodecahedral module according to the present invention. Opposing peripheral edges 32 and 34 comprise connector edges, represented graphically by double stripe 36. Opposing peripheral edges 38 and 40 comprise receptor edges, represented graphically by triple stripe 42. Connector edges 32 and 34 alternate at the periphery of panel 30 with receptor edges 38 and 40. Connector edges 32 and 34 are designed to interconnect with receptor edges 38 and 40 of additional, adjacent panels—as indicated in FIG. 6A, which illustrates twelve identical panels 30 assembled into a closed rhombic dodecahedral module 48 according to the present invention.

Figure 18:
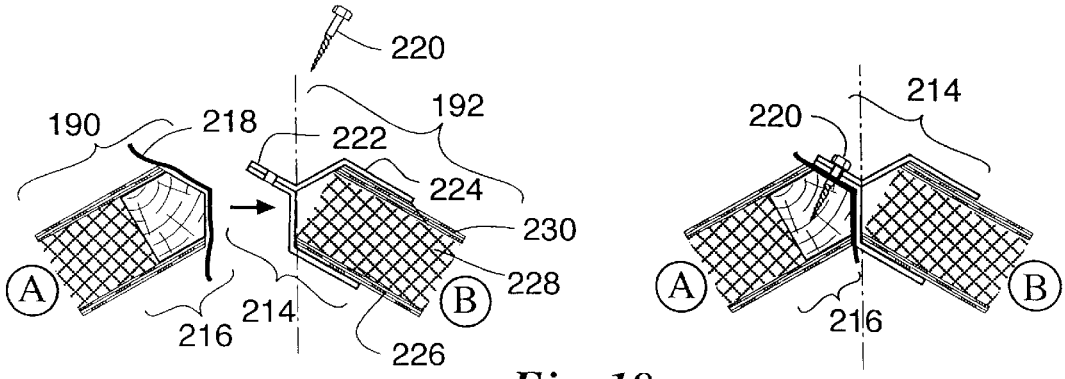
FIG. 18 provides a sectional view sequence of an interconnection between a connector edge and a receptor edge of two panels similar to the connector and receptor types depicted in FIG. 17, further including an optional gasket member between the two panels.
Figure 20:
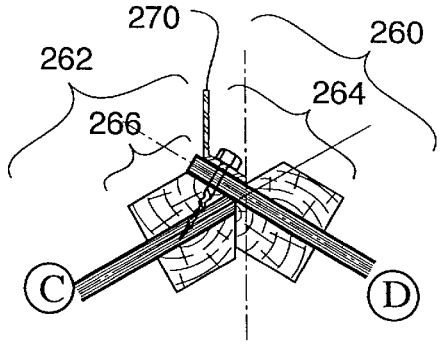
FIG. 20 provides a sectional view of an interconnection between a connector edge and a receptor edge of two panels according to the connector and receptor types depicted in FIG. 19.

FIG. 5B illustrates an alternate representation of a simplified front view of one panel 60 of a rhombic dodecahedral module according to the present invention. Opposing peripheral edges 62 and 64 comprise connector edges, represented graphically by outward arrow 66, pointing in a direction away from panel center 65. Opposing peripheral edges 68 and 70 comprise receptor edges, represented graphically by inward arrow 72, pointing in a direction toward panel center 65. As described previously, connector edges 62 and 64 are designed to interconnect with receptor edges 68 and 70 of additional, adjacent panels, as indicated in FIG. 6B, which illustrates twelve identical panels 60 assembled into a closed dodecahedral module 78 according to the present invention. Discussed below, FIGS. 18 and 20 provide examples of specific types of edge receptors and connectors that may be used in the invention, and which may be understood with reference to the graphical representations of FIGS. 5*a*/6*a* and FIGS. 5*b*/6*b*.

FIG. 7 illustrates a simplified front view of a hexagonal panel 80 according to the present invention in solid lines, compared with a simplified front view of a compatible rhombic panel 82 (shaded, and in dashed lines) identical to the rhombic panel shown in FIG. 5. As indicated by arrows 84, the shape of hexagonal panel 80 is derived from the shape of rhombic panel 82 by substituting parallel vertical edges 86 and 88 for vertices 90 and 92 of rhombic panel 82, or stretching the shape of rhombic panel 82 into the shape of hexagonal panel 80. Hexagonal panel 80 and rhombic panel 82 are compatible because hexagonal panel 80 and rhombic panel 82 share common edge lengths and corner angles, at edges other than parallel edges 86 and 88; as will be explained below, however, compatibility does not require that all non-vertical edges be of equal length. Hexagonal panel 80 and rhombic panel 82, when equipped with alternating connector and receptor edges (as per FIGS. 5*a*/5*b* and FIGS. 6*a*/6*b*) can be interconnected into one or more modules. Unless otherwise stated, all panels illustrated in the following figures should be understood to include alternating connector and receptor edges, whether or not explicitly illustrated.

Figure 8:
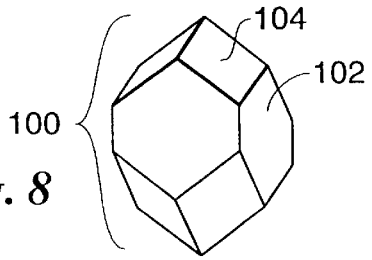
FIG. 8 provides a perspective view of a modified (hexagonal), closed dodecahedral module, composed of four hexagonal panels and eight rhombic panels.

FIG. 8 illustrates a simplified perspective view of a modified (hexagonal) closed dodecahedral module 100 according to the present invention. This module is formed by four hexagonal panels 102 and eight rhombic panels 104.

Figure 9:
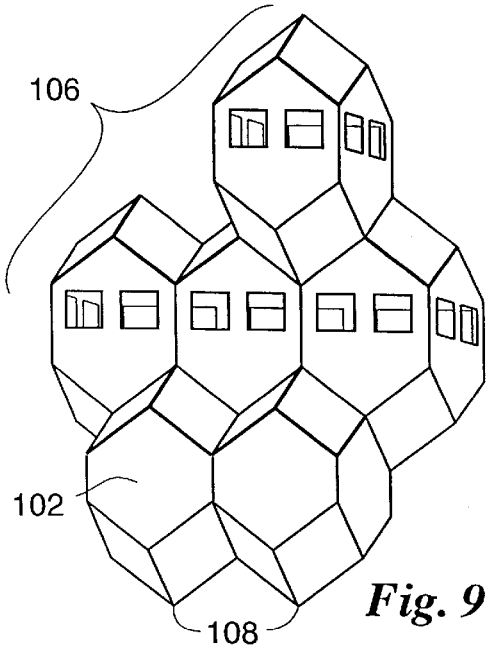
FIG. 9 provides a perspective view of a structure composed of modified (hexagonal) dodecahedral modules.

FIG. 9 illustrates a structure 106 fashioned from several interconnected modified (hexagonal) dodecahedral modules 102 (as depicted in FIG. 8) according to the present invention. Because this structure 106 is not flat on the bottom, but rather has two four-point vertices 108 of lowermost modules 102 at its lowest point, it may be suited for affixing to an uneven surface (not indicated) such as a hillside. Though not illustrated, connection of the structure to an underlying surface may be accomplished, for example, with supporting columns.

Figure 10A:
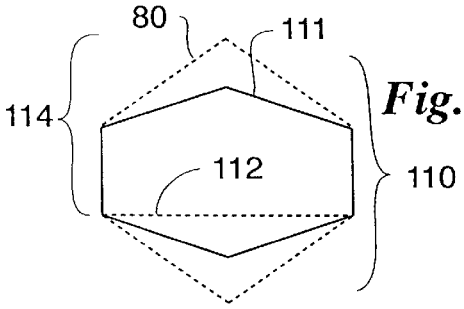
FIG. 10*a* provides a simplified front view of an alternative hexagonal panel (in solid lines) of a modified (hexagonal) dodecahedral module, compared with the hexagonal panel depicted in FIG. 7 (shadowed-outer dashed lines) and a pentagonal base panel (shadowed-horizontal dashed line).

FIG. 10*a* illustrates a simplified front view (in solid lines) of a hexagonal panel 110 according to the present invention, which is shorter in height than the hexagonal panel 80 illustrated in FIG. 7 (the outline of which is reprinted in shadow in FIG. 10*a*). Hexagonal panels of various heights and height/width ratios may be employed according to present invention to construct modules—and therefore structures—with varied functional qualities and aesthetics. Hexagonal panel 110, which appears compressed in comparison to hexagonal panel 80, is characterized by having shorter non-vertical edges relative to hexagonal panel 80. Horizontal edge 112 (shadowed) is provided to illustrate that, when combined with the solid lines provided above it, the shape of pentagonal base panel 114 is formed by truncating the shape of hexagonal panel 100. The horizontal bottom, formed by horizontal edge 112, of the resulting pentagonal base panel 114 makes it suitable for attaching to an underlying flat surface, such as a ground slab or an underlying floor of a pre-existing structure.

Figure 10B:
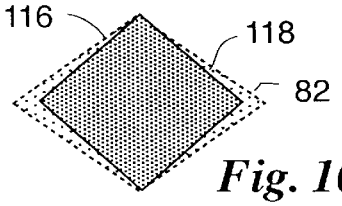
FIG. 10*b* illustrates a simplified front view of an alternative rhombic panel (darkly shaded, in solid lines) of a modified dodecahedral module, compared with the rhombic panel depicted in FIG. 7 (shadowed and lightly shaded).

FIG. 10*b* illustrates a simplified front view (darkly shaded, in solid lines) of a rhombic panel 116 according to the present invention in comparison with the rhombic panel 82 illustrated in FIG. 7 (the outline of which is reprinted in light shadow in FIG. 10*b*). Panel 116 is compatible with panels 110 and 114 because the length of edges 118 is equal to that of edge 111 (provided in FIG. 10*a*). Similar to the hexagonal panels depicted in FIG. 10*a*, rhombic panels of various edge lengths and corner angles are embodied within the present invention.

Figure 11:
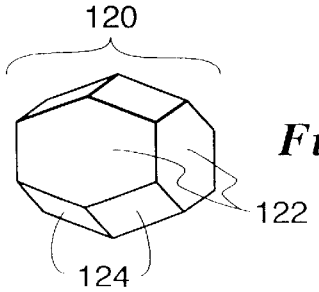
FIG. 11 provides a perspective view of an alternative modified (hexagonal) closed dodecahedral module, composed of four hexagonal panel and eight rhombic panels.

FIG. 11 illustrates a simplified perspective view of a modified (hexagonal) closed dodecahedral module 120 according to the present invention. This module is formed by four hexagonal panels 122—similar to the hexagonal panel illustrated in FIG. 10*a*—and eight rhombic panels 124 similar to panel 116 of FIG. 10*b*.

Figure 12:
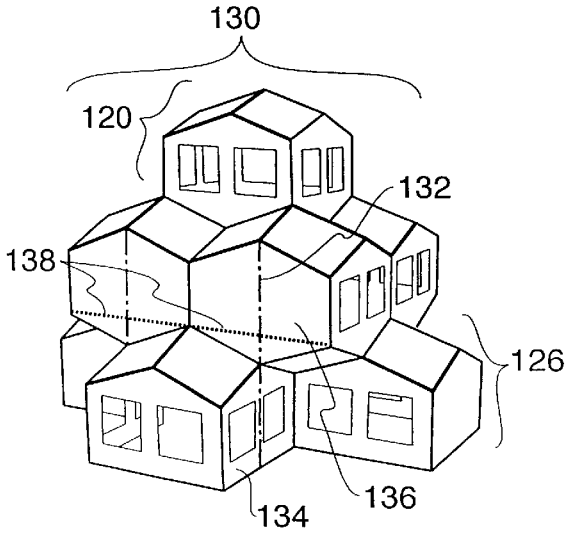
FIG. 12 provides a perspective view of a structure composed of modified (hexagonal) dodecahedral modules and base modules.

FIG. 12 illustrates a preferred embodiment of a structure 130 fashioned from several interconnected modified (hexagonal) dodecahedral modules 120 (as depicted in FIG. 11) and (pentagonal) base modules 126 according to the present invention. Being flat on the bottom, this structure 130 is suitable for affixing to a flat underlying surface, using prior art methods well known in the art. The positioning of optional supporting columns 132 is illustrated with vertical lines; columns 132 may connect vertically adjacent panel faces, such as panel faces 134 and 136, even though such faces are disposed in perpendicular planes. FIG. 12 also illustrates optional horizontal cross-members 138 for attaching one or more floor members (not illustrated) located at the interior of the structure.

Figure 13A:
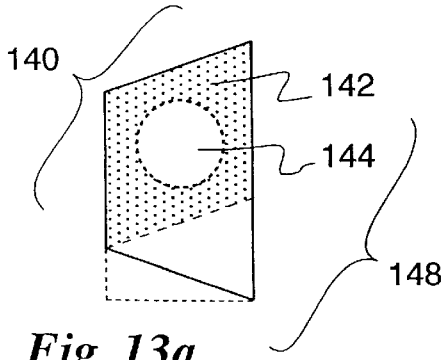
FIG. 13A provides a front view of a trapezoidal panel (in solid lines) of a modified (trapezoidal) dodecahedral module, including a cutout for a window or skylight, compared with compatible rhombic and right trapezoidal base panels (shadowed).

FIG. 13*a* illustrates a simplified front view (in solid lines) of a trapezoidal panel 140 according to the present invention. For comparison, a compatible rhombic panel 142 is also illustrated—shaded and bounded by long-dashed lines. An aperture 144 is defined within rhombic panel 142, or alternatively, within trapezoidal panel 140. Though aperture 144 is depicted as round, apertures in myriad different shapes could be fashioned inside a panel for mounting a window or skylight, as will be apparent to one skilled in the art. FIG. 13*a* also illustrates, with short-dashed lines, the boundary of a right trapezoidal base panel 148 which would be used to form a modified (trapezoidal) base module such as those shown in FIG. 14 (164).

Figure 13B:
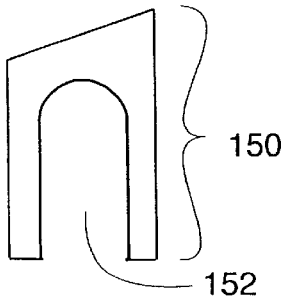
FIG. 13B provides a front view of a trapezoidal base panel (in solid lines) of a modified dodecahedral module, including a cutout for a door, compared with compatible rhombic side variation (shadowed).

FIG. 13*b* illustrates a simplified front view (in solid lines) of a right trapezoidal panel 150 according to the present invention, with an optional extended cut-out 152 to serve as a doorway or a location for mounting a door or long window. Panel 150 is dimensionally identical to panel 148 provided in FIG. 13*a*. Optional extended cut-out 152 may be either unbounded, as depicted in FIG. 13*b*, or bounded by a bottom sill 158 (as depicted in panels comprising the base modules 164 at either end of structure 160 in FIG. 14).

Figure 14:
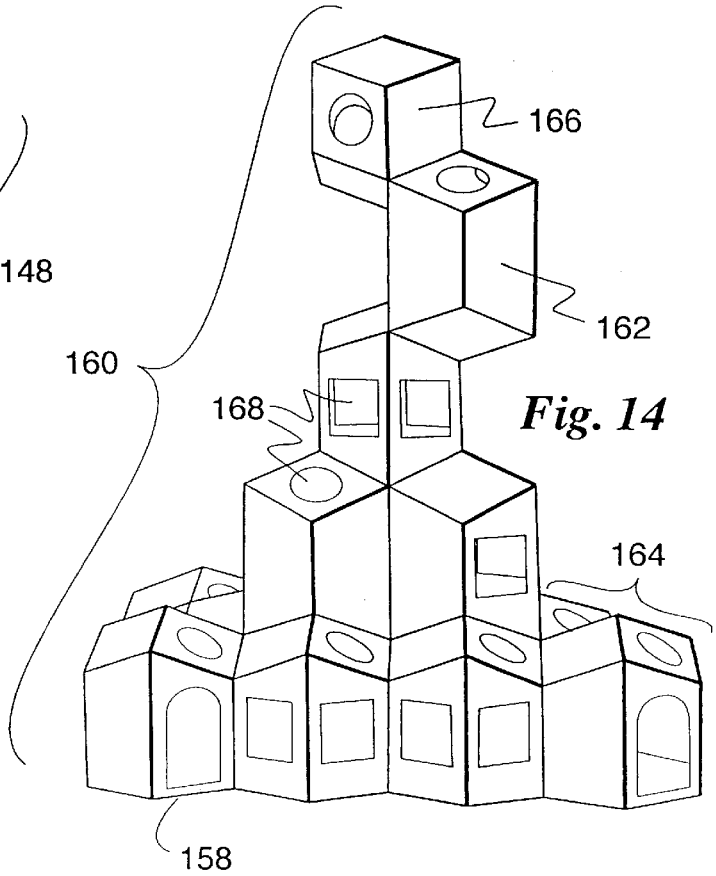
FIG. 14 provides a perspective view of a structure composed of modified (trapezoidal) dodecahedral modules, base modules, and a single rhombic dodecahedral module.

FIG. 14 illustrates a complex structure 160 according to the present invention, composed of modified (trapezoidal) dodecahedral modules 162, base modules 164, and a single rhombic dodecahedral module 166. Various apertures 168 are defined by different panels, the apertures here depicted as either square or round in shape.

All of the preceding figures have illustrated simplified representations of embodiments of the present invention, wherein panel connection details were not provided. Further, the panels in preceding figures were depicted with idealized (zero) thickness. We will now turn to more realistic representations of embodiments of the present invention.

Figure 15:
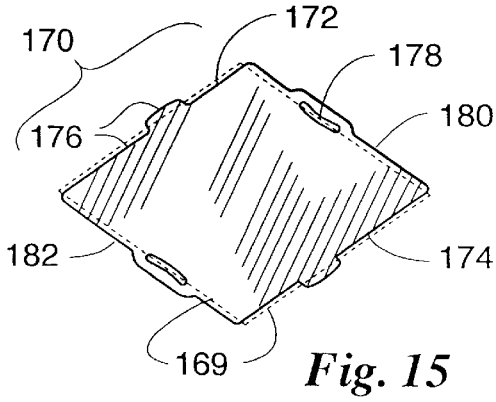
FIG. 15 provides a front view of a rhombic panel with tab connector and slot receptor edges.

FIG. 15 illustrates a single rhombic panel 170 for use in embodiments of the invention such as play equipment, toys, or models. For comparison, an idealized rhombic panel 169 with zero thickness and equilateral edges is also provided, in dashed lines, similar to panels 82, 60, and 30 illustrated previously. Connector edges 172, 174 each contain an outwardly-protruding tab 176 which is sized to permit insertion into slot 178 contained on receptor edges 180, 182 of adjacent panels. Though only one tab 176 per connector edge or one slot 178 per receptor edge is illustrated, multiple tabs or slots may be provided at each corresponding edge. Moreover, the simple tab and slot edge connection type illustrated is intended to be exemplary only. As would be apparent to those skilled in the art, similar but alternative edge connection types could be employed. Preferred embodiments directed toys, play equipment, or models would include panels fabricated from either a durable plastic, wood, or other sheet materials well known in the art. Preferred materials for an embodiment directed to a toy or to a model would include panels fabricated from plastic, wood, foam, metals or other materials well known in the art.

Connector edges 172, 174 are equal in length, but longer than receptor edges 180, 182. The differential lengths between connector edges 172, 174 and receptor edges 180, 182 provides some overlap between panels at edges of a module. The degree of differential length varies with the panel thickness relative to panel edge lengths. Connector edges 172, 174 of one panel and receptor edges 180, 182 of an adjacent panel remain compatible—despite the differential lengths between the two edge types—so long as multiple panels may be interconnected into a substantially closed structure and the differential lengths between the edges do not interfere with each other at the module vertices.

Figure 16:
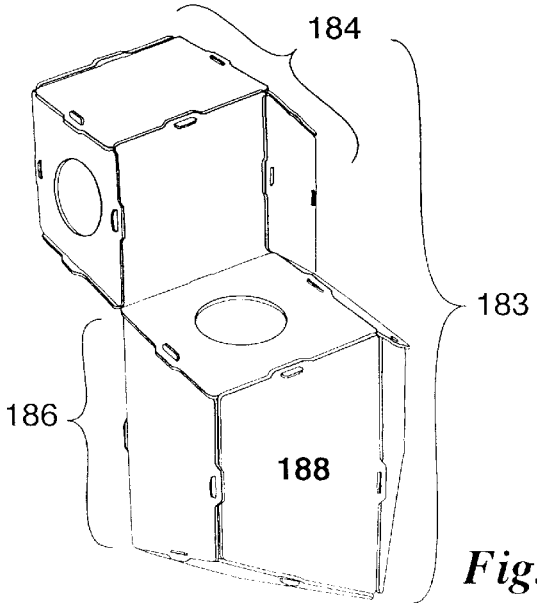
FIG. 16 provides an oblique perspective view of a structure composed of a modified (trapezoidal) module and a rhombic dodecahedral modul, with the panels composing the module having tab connector and slot receptor edges.

FIG. 16 illustrates a perspective view of a structure 183 composed of two interconnected modules—one rhombic dodecahedral module 184 and one modified (trapezdoidal) dodecahedral module 186. All panels composing modules 184 and 186 have tab connector and slot receptor edges. Vertex 188 illustrates the overlap between panels provided by the differential lengths between connector edges 172, 174, and receptor edges 180, 182.

Figure 17:
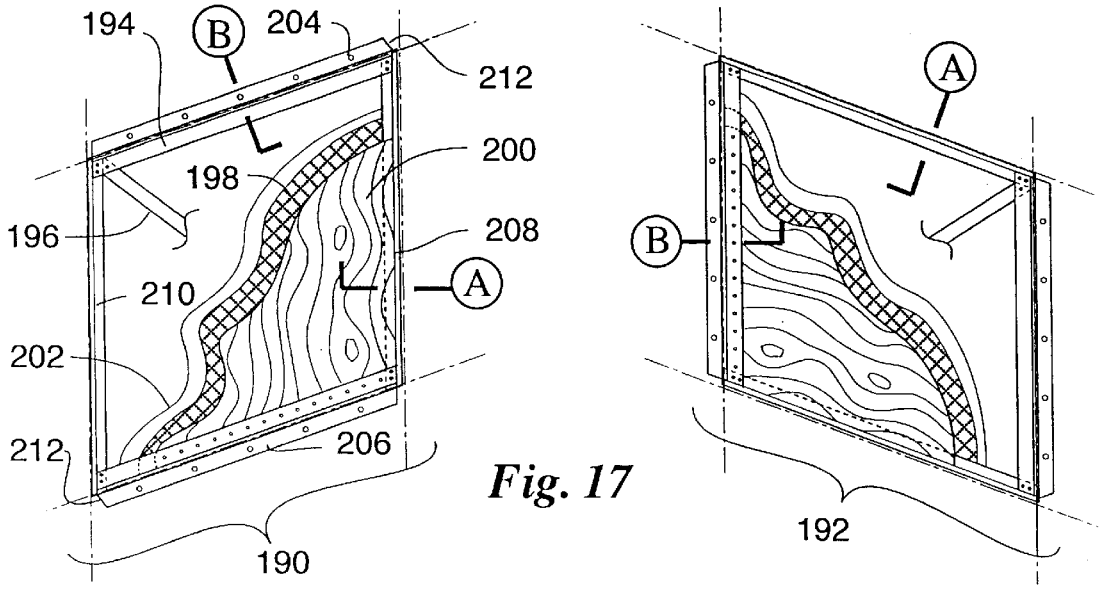
FIG. 17 provides a partially cut-away front view of two rhombic panels, each composed of a peripheral frame with cross member, a central insulation layer, and interior and exterior panel layers.

FIG. 17 illustrates a partially cut-away front view of two rhombic panels 190 and 192 according to a preferred embodiment directed to habitable or commercial structures. Each panel is composed of a peripheral frame 194 with optional cross member 196, an optional central insulation layer 198, an interior panel layer 200, and an exterior panel layer 202. Each panel has two connector edges 204, 206, and two receptor edges 208, 210. Optional cross-member 196 is designed to enhance the rigidity and strength of the panel should such enhancements be necessary. Connector edges 204, 206 are designed to interconnect with receptor edges 208, 210 of adjacent panels. Connector edges 204, 206 each have an optional single beveled corner 212 to reduce interferences between multiple panels at module vertices.

Though an inexpensive, preferably galvanized, metal would be a preferred material for peripheral frame 194 and cross-member 196, this component may alternatively be fabricated from wood, rigid plastic, composites, or a combination of these or similar low-cost and high-strength materials, as would be apparent to one skilled in the art. Panel layers 200 and 202, though preferably fabricated from wood as illustrated in FIG. 17, may be alternatively fabricated from rigid plastics, metals, composites, or other similar materials well known in the art. Though both inside and outside panel layers 200 and 202 are illustrated, a lower-cost structure may be yielded utilizing only a single panel layer. Optional central insulation layer 198 contained in the cavity between interior panel layer 200 and exterior panel layer 202, or simply affixed to the interior surface of exterior panel 202 in the case of a single panel layer embodiment, may be fabricated with fiberglass insulating material, solid foam, injectable liquid foam, or other insulating materials which would be apparent to one skilled in the art. Where insulating layer 198 is omitted, panel layers 200 and 202 may be fabricated from translucent materials such as glass or translucent plastic to convert the entire panel 190, 192 into a window or skylight.

While illustrating a preferred embodiment of edge connections suitable for a habitable or commercial structure, connector edges 204, 206 are intended to be exemplary only of possible connector types. The connector type as illustrated requires hardware (not shown) such as nails, screws, or bolts and nuts to interconnect multiple panels. Similar but alternative edge connection types known in the art could be employed.

FIG. 18 illustrates a sectional view sequence of an interconnection between a connector edge 214 and a receptor edge 216 (identical to the connector and receptor edge types illustrated in FIG. 17) of two panels 190 and 192, including an optional gasket member 218 between the two panels to aid in sealing out the elements. Connecting panels 190 and 192 is accomplished by driving multiple screws 220 (only one screw shown) through protruding portion 222 of connector edge 214 and into receptor edge 216. As illustrated, the peripheral frame at connector edge 214 may be formed by a connecting member 224 which surrounds interior panel layer 226, central insulating layer 228, and exterior panel layer 230. Connecting member may be integral to the panel or separable, and may be fabricated from galvanized metal, plastic, or another suitable material well known in the art. The peripheral frame at receptor edge 216 may be of a different material than that located at the connector edge 214; it is illustrated as fabricated from wood, although it may alternatively be fabricated from metal, plastic, or another suitable material known in the art.

Figure 19:
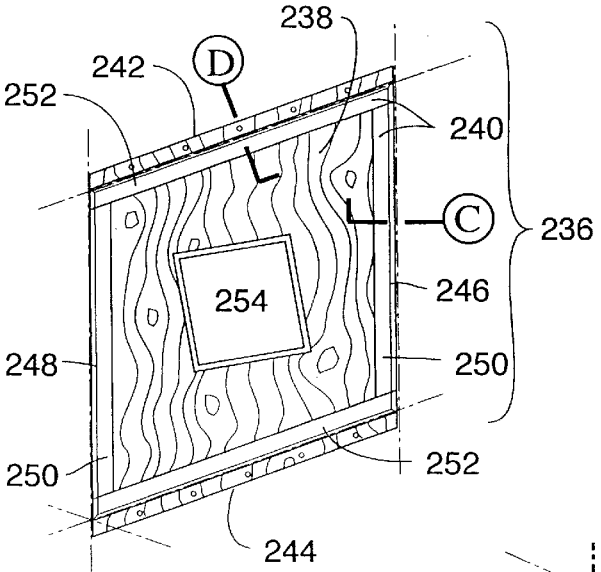
FIG. 19 provides a front view of a rhombic panel composed of a single panel layer, with the panel containing a square aperture for a window or skylight.

FIG. 19 provides a front view of a rhombic panel 236 which is composed of a single panel layer 238 and a peripheral frame 240 with panel connector edges 242, 244, and panel receptor edges 246, 248. Peripheral frame 240 may be fabricated simply by affixing frame members 250, 252 to panel layer 238, such as with adhesives, nails, screws, or other methods well known in the art. A preferred embodiment of rhombic panel 236 is illustrated as being fabricated entirely from wood, although it may alternatively be fabricated from any combination of metal, plastic, or another suitable materials well known in the art. Panel layer 238 is illustrated with an optional square aperture 254 to mount (or to serve as) or to mount, a window or skylight.

FIG. 20 provides a sectional view of an interconnection between a connector edge 264 and a receptor edge 266 (identical to the connector and receptor edge types illustrated in FIG. 18) of two panels 260, 262. Connection between the panels is accomplished similarly as described for FIG. 19, but FIG. 20 omits the optional gasket member and includes an optional protruding tab 270. Optional protruding tab 270 may serve as an additional connector edge, for connecting a receptor edge of a third panel (not shown) to panels 260, 262.

Figure 21:
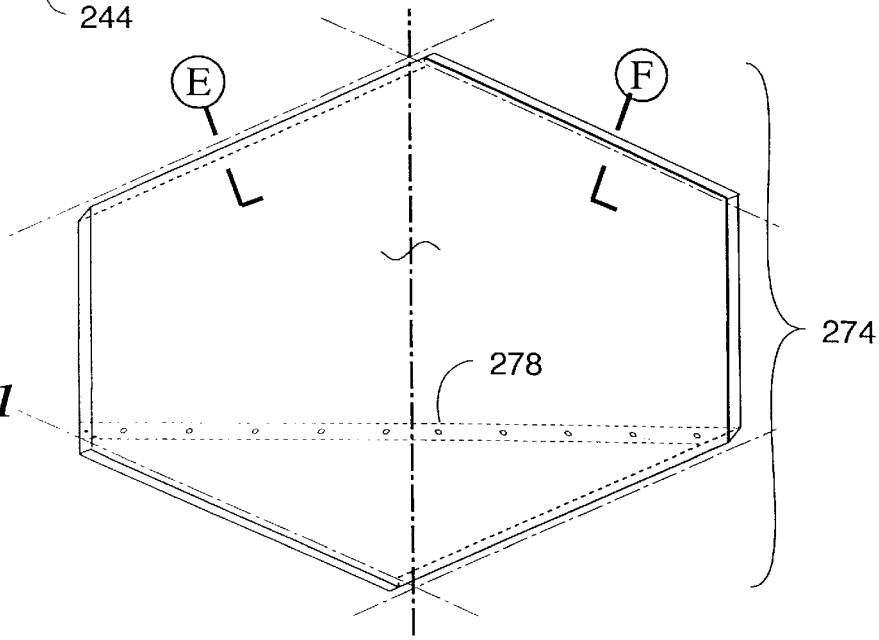
FIG. 21 provides a simplified front view of a hexagonal panel, depicting a horizontal cross member (shadowed).

FIG. 21 provides a front view of a hexagonal panel 274, depicting a preferred embodiment with a horizontal cross member 278 (shadowed) to which an interior floor member (not shown) may be attached. Horizontal cross member 278 is similar to the simplified horizontal cross member 138 depicted in FIG. 12. Hexagonal panel 274 may be designed as illustrated with a length differential between connector edges and receptor edges. Hexagonal panel 274 is preferably formed from a plastic or composite material.

Figure 22:
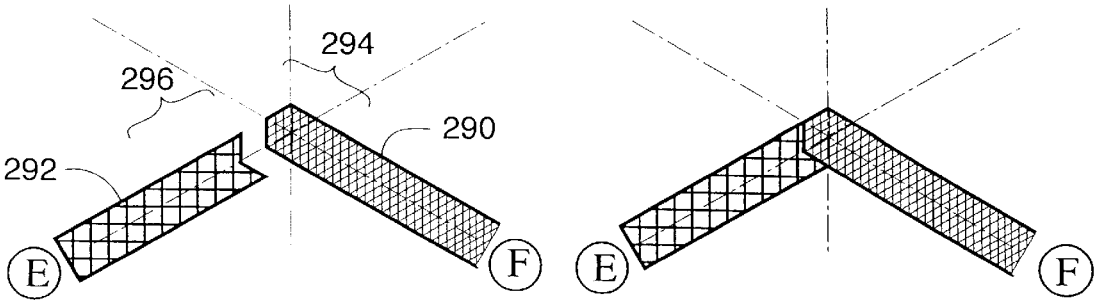
FIG. 22 provides a sectional view sequence of an interconnection between a connector edge and a receptor edge of two cast or molded panels, similar to the connector and receptor types depicted in FIG. 21.

FIG. 22 provides a sectional view sequence of an interconnection between a connector edge 294 and a receptor edge 296 of two cast or molded panels 290, 292, fabricated from a plastic or composite material. Connection between adjacent panels may be achieved without additional connectors by way of adhesives or other methods well known in the art.

What is claimed is:

1. A modular dodecahedral-based construction system comprising:

a plurality of planar rhombic panels, each rhombic panel having four peripheral edges, said four peripheral edges of each rhombic panel consisting of alternating panel connector and panel receptor edges to provide a total of two panel connector edges and two panel receptor edges per rhombic panel; and a plurality of planar hexagonal panels, each having six peripheral edges, said six peripheral edges of each hexagonal panel consisting of alternating panel connector and panel receptor edges to provide a total of three panel connector edges and three panel receptor edges per hexagonal panel;

wherein each of said peripheral edges of each rhombic panel and each hexagonal panel defines either a panel connector edge or a panel receptor edge, and said panel connector edges differ in type from said panel receptor edges; and wherein one said panel connector edge of a first panel of said pluralities of rhombic and hexagonal panels is formed to interconnect with one of said panel receptor edges of a second panel of said pluralities of rhombic and hexagonal panels.

2. The construction system according to claim 1, wherein each panel of said pluralities of rhombic and hexagonal panels is interconnected with at least one other panel of said pluralities of rhombic and hexagonal panels to form at least one module.

3. The construction system according to claim 1, wherein said pluralities of planar rhombic and hexagonal panels are pre-manufactured.

4. The construction system according to claim 1, wherein each panel of said pluralities of rhombic and hexagonal panels comprises a peripheral frame and at least one panel layer attached to said frame.

5. The construction system according to claim 4, wherein said at least one panel layer of at least one of said panels of said pluralities of rhombic and hexagonal panels is translucent.

6. The construction system according to claim 4, wherein said peripheral frame of at least one of said panels is reinforced with at least one cross-member to enhance the strength of the panel.

7. The construction system according to claim 4, wherein said peripheral frame of at least one of said panels comprises at least one cross-member formed to securely fasten a floor member located at the interior of the structure.

8. The construction system according to claim 4, wherein each panel comprises an interior layer and an exterior layer, and further wherein said layers are separate from each other and define a cavity interior to each panel.

9. The construction system according to claim 1, wherein at least one panel of said plurality of panels defines an aperture.

10. The construction system according to claim 1, further comprising gasket members between said panels.

11. A modular dodecahedral-based construction system according to claim 3, further comprising:

a plurality of planar base panels, selected from the group of shapes consisting of pentagonal and right trapezoidal, each base panel having a plurality of peripheral edges consisting of one surface connector edge and alternating panel connector and panel receptor edges at the remainder of said peripheral edges, wherein each peripheral edge that is not a surface connector edge defines either a panel connector edge or a panel receptor edge; and wherein one said panel connector edge of a first panel of said pluralities of base and rhombic panels is formed to interconnect with one of said panel receptor edges of a second panel of said pluralities of base and rhombic panels.

12. The construction system according to claim 11, wherein at least one base panel defines a cutout portion along said surface connector edge for mounting a door.

13. The construction system according to claim 11, wherein each base panel is pentagonal in shape and has one surface connector edge, two panel connector edges, and two panel receptor edges.

14. A construction system comprising a plurality of dodecahedral-based modules joined to form a structure having an interior and an exterior, each module comprising:

a plurality of planar hexagonal panels each having six peripheral edges consisting of alternating panel connector and panel receptor edges to provide a total of three panel connector edges and three panel receptor edges wherein each of said six peripheral edges of each hexagonal panel defines either a panel connector edge or a panel receptor edge, and said panel connector edges differ in type from said panel receptor edges; and a plurality of planar rhombic panels each having four peripheral edges consisting of alternating panel connector and panel receptor edges to provide a total of two panel connector edges and two panel receptor edges per rhombic panel wherein each of said four peripheral edges of each rhombic panel defines either a panel connector edge or a panel receptor edge, and said panel connector edges differ in type from said panel receptor edges;

wherein one said panel connector edge of a first panel of said pluralities of rhombic and hexagonal panels is formed to interconnect with one of said panel receptor edges of a second panel of said pluralities of rhombic and hexagonal panels.

15. The construction system according to claim 14, further comprising at least one support column attached to at least one of said panels.

16. The construction system according to claim 15, wherein:

at least one panel of said plurality of panels is positioned in a vertical plane, said at least one vertical panel having a vertical centerline; and said at least one support column is attached to said at least one vertical panel along the vertical centerline of said panel at the exterior of the structure.

17. The construction system according to claim 15, wherein said at least one support column is attached to said at least one panel at the interior of the structure.

18. A modular dodecahedral-based construction system comprising:

a plurality of planar rhombic panels, each rhombic panel having four peripheral edges, said four peripheral edges of each rhombic panel consisting of alternating panel connector and panel receptor edges to provide a total of two panel connector edges and two panel receptor edges per rhombic panel;

wherein each of said edges of each rhombic panel defines either a panel connector edge or a panel receptor edge, and said panel connector edges differ in type from said panel receptor edges; and wherein one of said panel connector edges of a first rhombic panel of said plurality of rhombic panels is formed to interconnect with one of said panel receptor edges of a second rhombic panel of said plurality of rhombic panels; and a plurality of planar hexagonal panels, each having six peripheral edges, four of said six peripheral edges of each hexagonal panel consisting of alternating panel connector and panel receptor edges to provide a total of two panel connector edges and two panel receptor edges per hexagonal panel;

wherein each of said four peripheral edges of each hexagonal panel defines either a panel connector edge or a panel receptor edge, and said panel connector edges differ in type from said panel receptor edges; and wherein one said panel connector edge of a first hexagonal panel of said plurality of hexagonal panels is formed to interconnect with one of said panel receptor edges of a second panel of said plurality of rhombic panels, and one said panel receptor edge of a first panel of said plurality of hexagonal panels is formed to interconnect with one of said panel connector edges of a second panel of said plurality of rhombic panels.

* * * * *

UNITED STATES PATENT AND TRADEMARK OFFICE

CERTIFICATE OF CORRECTION

PATENT NO. : 6,173,538 B1
DATED : January 16, 2001
INVENTOR(S) : Gregg R. Fleishman It is certified that error appears in the above-identified patent and that said Letters Patent is hereby corrected as shown below:

Title page,
Item [56], References Cited, U.S. PATENT DOCUMENTS, change "4,611,411 * 9/1986 Wickens…….52/81.4" to read -- 4,611,441 * 9/1986 Wickens…….52/81.4 --.
Item [56], OTHER PUBLICATIONS, insert -- Pearce, Peter; "Structure in Nature is a Strategy for Design," pp. 48-49, 62-64 (MIT Press: Cambridge, MA, USA and London England.) (1990) --.

Column 3,
Line 60, change "modul" to read -- module --.

Signed and Sealed this

Sixth Day of August, 2002

*Attest:*

*Attesting Officer*

JAMES E. ROGAN
*Director of the United States Patent and Trademark Office*